United States Patent [19]

Florens

[11] 3,963,494

[45] June 15, 1976

[54] PHOTOGRAPHIC MULTILAYER DIRECT-POSITIVE SILVER HALIDE ELEMENT

[75] Inventor: Raymond Leopold Florens, Edegem, Belgium

[73] Assignee: AGFA-GEVAERT N.V., Mortsel, Belgium

[22] Filed: Jan. 11, 1974

[21] Appl. No.: 432,532

[30] Foreign Application Priority Data

Jan. 25, 1973 United Kingdom ..... 3903/73

[52] U.S. Cl. ..... 96/69; 96/64; 96/107

[51] Int. Cl.[2] ..... G03C 1/76; G03C 5/24; G03C 1/28

[58] Field of Search ..... 96/69, 64, 107, 100, 96/101

[56] References Cited

UNITED STATES PATENTS

| | | | |
|---|---|---|---|
| 2,930,694 | 3/1940 | Coeenew et al. | 96/100 |
| 3,314,796 | 4/1957 | Gotze et al. | 96/101 |
| 3,501,307 | 3/1970 | Illingsnorth | 96/101 |
| 3,501,312 | 3/1970 | DeeMee et al. | 96/106 |
| 3,615,610 | 10/1971 | Florens et al. | 96/104 |
| 3,746,549 | 7/1973 | Corretore, Jr. et al. | 96/126 |
| 3,854,953 | 12/1974 | Shiba et al. | 96/101 |

*Primary Examiner*—David Klein
*Assistant Examiner*—L. Y. Falasco
*Attorney, Agent, or Firm*—A. W. Breiner

[57] ABSTRACT

A photographic multilayer direct-positive silver halide element is provided comprising at least two direct-positive fogged silver halide emulsion layers the undermost emulsion layer comprising one or more non-spectrally sensitizing electron acceptors and the uppermost emulsion layer comprising one or more electron-acceptors at least one of which is a spectrally sensitizing electron acceptor. The direct-positive element has reduced gradation and extended exposure latitude.

14 Claims, No Drawings

PHOTOGRAPHIC MULTILAYER DIRECT-POSITIVE SILVER HALIDE ELEMENT

The present invention relates to photographic elements comprising superposed direct-positive silver halide emulsion layers.

It is known that direct-positive images can be obtained with certain types of photographic silver halide emulsions without previously forming a negative silver image. For this purpose, the silver halide grains are fogged, before or after coating on a support, by an overall exposure to actinic radiation or by overall chemically fogging e.g. by means of reducing agents. Upon image-wise exposure of the prefogged emulsions the development centres formed by said fogging are destroyed at the exposed areas and remain at the unexposed areas. By subsequent conventional development by means of silver halide developers a direct-positive image is formed.

The destruction of the development centres during imagewise exposure is generally based on the Herschel effect or the solarization effect. For the first effect, exposure occurs with long wavelength light whereas for the second effect exposure occurs by means of short wavelength light. Both processes remained of little practical importance because the common silver halide emulsions have rather low speed.

The speed of direct-positive emulsions can be improved by adapting the fogging conditions and by addition of desensitizing agents acting as electron traps. Such emulsions have been described in United Kingdom Pat. No. 723,019 filed Feb. 5, 1952 by Gevaert Photo-Producten N.V., where fogging occurs by means of reducing agents in the presence of compounds of a metal more electropositive than silver.

For the reproduction of continuous-tone images direct-positive silver halide emulsions with low gradation and high exposure latitude are necessary to obtain optimum reproduction of every tone level of the image to be reproduced.

In order to extend the exposure latitude of direct-positive emulsions it has been proposed e.g. in U.S. Pat. No. 3,615,573 of Albert C. Smith Jr. and Bernard D. Illingsworth, issued Oct. 26, 1971, to mix silver halide emulsions which have been selectively fogged to various fog levels. By admixture of a sufficient number of such differently fogged emulsions, distinct high-contrast steps are provided on a Density vs. Log. Exposure curve and the overall effect is reduced contrast. This method of reducing the contrast is of limited practical interest since the preparation of multiple differently fogged silver halide emulsions is relatively complicated and lacks sufficient reproducibility.

In accordance with the present invention a photographic multilayer direct-positive silver halide element is provided which has reduced gradation and extended exposure latitude, the said element comprising a support, at least two direct-positive silver halide emulsion layers each containing fogged silver halide grains, and optionally intermediate and/or surface layers wherein the undermost emulsion layer of the said two silver halide emulsion layers comprises one or more electron-accepting compound(s) that is (are) non-spectrally sensitizing and the uppermost layer of the said two silver halide emulsion layers comprises one or more electron-acceptors at least one of which is a spectrally sensitizing electron-acceptor.

It is known to characterize electron-acceptors or desensitizers for use in direct-positive silver halide emulsions in terms of their polarographic half-wave potentials i.e. their oxidation reduction potentials determined by polarography. Each of the spectrally sensitizing and non-spectrally sensitizing electron-acceptors useful in accordance with the present invention has an anodic polarographic half-wave potential and a cathodic polarographic half-wave potential which, when added together, give a positive sum. Methods of determining these polarographic half-wave potentials have been described in U.S. Pat. 3,501,310 of Bernard D. Illingsworth, issued Mar. 17, 1970 and 3,531,290 of Roberta A. Litzerman, issued Sept. 29, 1970.

Spectrally sensitizing electron-acceptors in contrast to non-spectrally sensitizing electron-acceptors provide spectral sensitization beyond the inherent sensitivity region of the silver halide, e.g. in the case of silver bromide and silver bromoiodide emulsions in the range of the visible spectrum above about 480 nm.

Especially useful classes of electron-accepting, spectrally-sensitizing compounds for the uppermost direct-positive silver halide emulsion layer of the photographic element according to the invention are imidazoquinoxaline cyanine such as 1,1',3,3'-tetraethylimidazo[4,5-b]quinoxalino-carbocyanine chloride, and cyanine dyes containing an indole nucleus with carbocyclic aromatic ring in the 2-position e.g. those described in U.S. Pat. Nos. 2,930,694 of Russell Pearce Heuer, issued Mar. 29, 1960 and 3,501,312 of John D. Mee and Donald W. Heseltine, issued Mar. 17, 1970, such as 1,1-dimethyl-2,2'-diphenyl-3,3'-indolocarbocyanine bromide, 1,1'-dimethyl-2,2'-di-p-methoxyphenyl-3,3'-indolocarbocyanine bromide and 1,1'-dimethyl-2,2',8-triphenyl-3,3'-indolocarbocyanine perchlorate and U.S. Pat. No. 3,615,610 of Raymond Leopold Florens, Johannes Gotze, August Randolph and Theofiel Hubert Ghys.

Especially useful spectrally sensitizing electron-acceptors are described in the latter United States Patent; they can be represented by the formula:

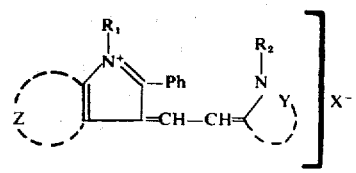

wherein:

each of $R_1$ and $R_2$ represents alkyl including substituted alkyl of the type generally known in cyanine dye chemistry such as methyl, ethyl, n-propyl, n-butyl, n-amyl, isopropyl, isobutyl, β-hydroxyethyl, β-acetoxyethyl, sulfoethyl, sulfopropyl, sulfobutyl, sulfatopropyl or sulfatobutyl, an unsaturated aliphatic group e.g. allyl, an aralkyl group e.g. benzyl, a substituted benzyl group such as carboxybenzyl, an aryl group e.g. phenyl, a substituted aryl group such as carboxyphenyl, a cycloalkyl group such as cyclohexyl and cyclopentyl or a substituted alkyl group such as the group —A—CO—O—B—$SO_2OH$ wherein each of A and B represents a hydrocarbon group or the group —A—W—NH—V—B, wherein A represents a methylene group, an ethylene group, a propylene group or a butylene group, B represents an alkyl group, an amino group, a substituted amino group and also a hydrogen atom if V is a single bond, and each of W and V represents a carbonyl group, a sulfonyl group or a single bond, but at least one of them representing a sulfonyl group, Ph represents a phenyl group including substituted phenyl e.g. an alkyl-, aryl-, alkoxy- or halogen substituted phenyl group, said substituents preferably standing in the p-position, Z represents the necessary atoms to form a fused-on benzene nucleus, which may be substituted e.g. by halogen, an alkyl, or an alkoxy group, $X^-$ represents an anion e.g. $Cl^-$, $Br^-$, $I^-$, $ClO_4^-$, $CH_3SO_4^-$ and but $X^-$ is not present if $R_1$ itself contains an anionic group, and Y represents the necessary atoms to complete a heterocyclic nucleus of the types used in the production of cyanine dyes e.g. such as those of the thiazole series e.g. thiazole, 4-methylthiazole, 4-methyl-5-carbethoxythiazole, 4-phenylthiazole, 5-methylthiazole, 5-phenylthiazole, 4-(p-tolyl)-thiazole, 4-(p-bromophenyl)-thiazole, 4,5-dimethylthiazole, 4,5-diphenylthiazole, 4-(2-thienyl)-thiazole, 4-(m-nitrophenyl)-thiazole, those of the benzothiazole series e.g. benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 6-sulphobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, 4,5,6,7-tetrahydrobenzothiazole, 5,6-dimethoxybenzothiazole, 5,6-dioxymethylenebenzothiazole, 5-hydroxybenzothiazole, 6-hydroxybenzothiazole, 5,6-dimethylbenzothiazole, those of the naphthothiazole series e.g. naphtho[2,1-d]thiazole, naphtho[1,2-d]thiazole, 5-methoxynaphtho[1,2-d]thiazole, 5-ethoxynaphtho[1,2-d]thiazole, 8-methoxynaphtho[2,1-d] thiazole, 7-methoxynaphtho[2,1-d]thiazole, those of the thionaphtheno[7,6-d]thiazole series e.g. 7-methoxythionaphtheno[7,6-d]thiazole, those of the thiadiazole series e.g. 4-phenylthiadiazole, those of the oxazole series e.g. 4-methyloxazole, 5-methyloxazole, 4-phenyloxazole, 4,5-diphenyloxazole, 4-ethyloxazole, 4,5-dimethyloxazole, 5-phenyloxazole, those of the benzoxazole series e.g. benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 6-methoxybenzoxazole, 5-hydroxybenzoxazole, 6-hydroxybenzoxazole, those of the naphthoxazole series, e.g. naphtho[2,1-d]oxazole, naphtho[1,2-d]oxazole, those of the selenazole series e.g. 4-methyl-selenazole, 4-phenylselenazole, those of the benzoselenazole series e.g. benzoselenazole, 5-chlorobenzoselenazole, 5-methoxybenzoselenazole, 5-hydroxybenzoselenazole, 4,5,6,7-tetrahydrobenzoselenazole, those of the naphthoselenazole series e.g. naphtho[2,1-d] selenazole, naphtho[1,2-d]selenazole, those of the 2-quinoline series e.g. quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, etc., those of the pyrimidine series, those of the quinoxaline series, those of the quinazoline series, those of the 1-phthalazine series, those of the 2-pyridine series e.g. pyridine, 5-methylpyridine, 3 -nitropyridine, those of the benzimidazole series e.g. benzimidazole, 5,6-dichlorobenzimidazole, 5-chlorobenzimidazole, 5,6-dibromobenzimidazole, 5-chloro-6-amino-benzimidazole, 5-chloro-6-bromobenzimidazole, 5-phenylbenzimidazole, 5-fluorobenzimidazole, 5,6-difluorobenzimidazole, 5-cyanobenzimidazole, 5,6-dicyanobenzimidazole, 5-chloro-6-cyanobenzimidazole, 5-fluoro-6-cyanobenzimidazole, 5-acetylbenzimidazole, 5-chloro-6-fluorobenzimidazole, 5-carboxy-benzimidazole, 7-carboxybenzimidazole, 5-carbethoxybenzimidazole, 7-carbethoxybenzimidazole, 5-sulfphamylbenzimidazole, or 5-N-ethylsulphamylbenzimidazole.

Examples of dyes corresponding to the said general formula are listed in the following table 1.

Table 1

1.

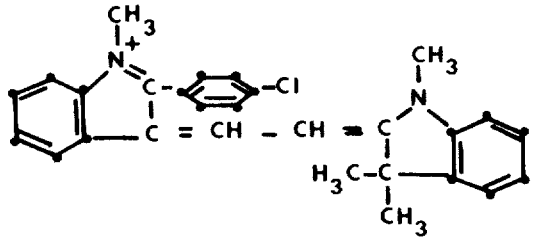

2.

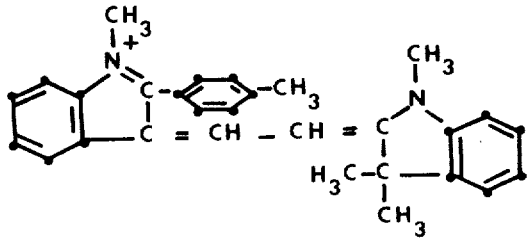

-continued
3. 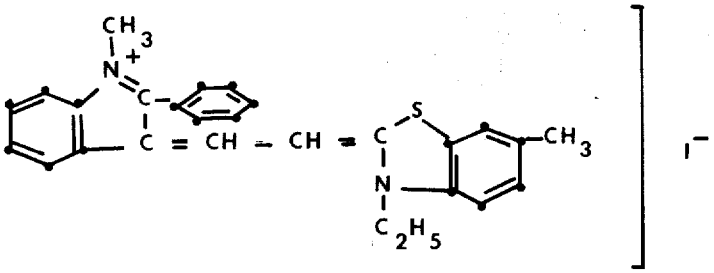
4. 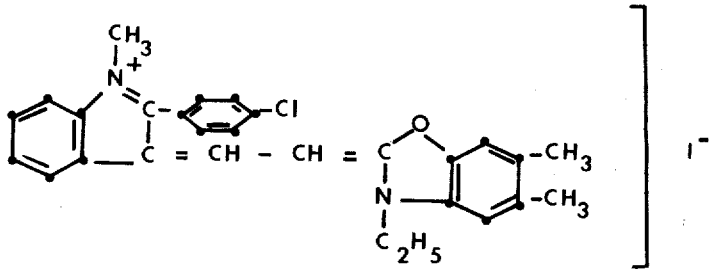
5. 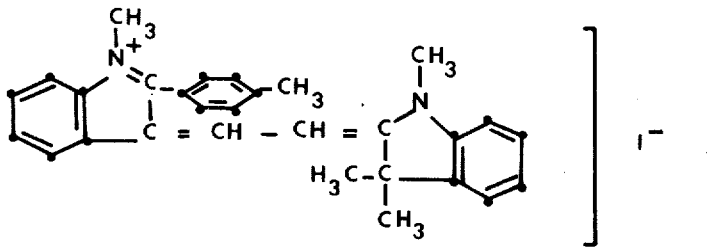
6. 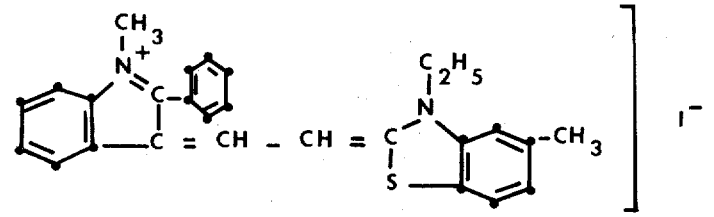
7. 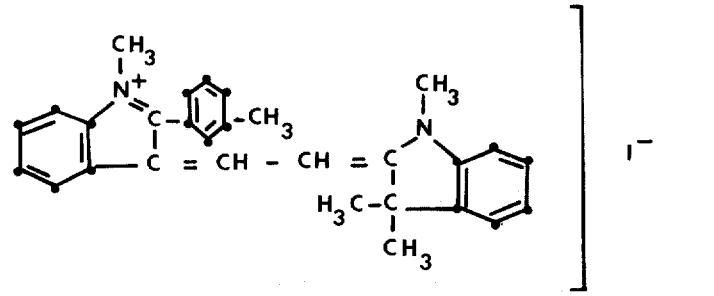
8. 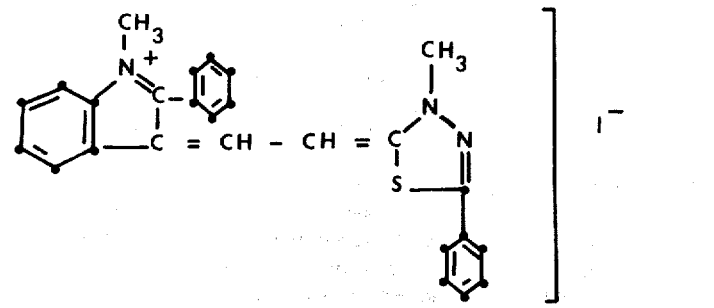

9. 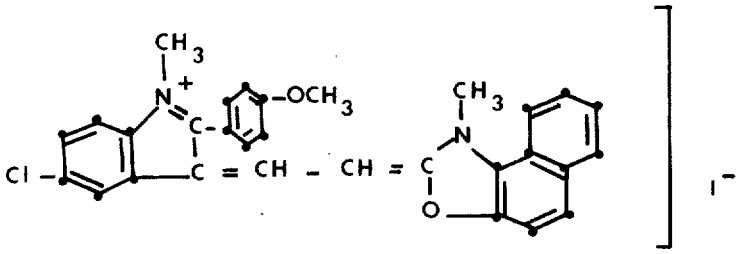

10. 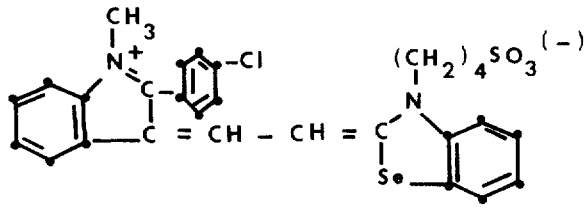

Examples of other spectrally sensitizing electron-acceptors can be found in U.S. Pat. No. 3,501,307 of Bernard D. Illingsworth, issued Mar. 17, 1970, e.g. cyanine and merocyanine dyes in which at least one nucleus and preferably two nuclei contain desensitizing substituents such as nitro e.g. 3,3'-diethyl-6,6'-dinitrothiocarbocyanine chloride, 1',3-diethyl-6nitrothia-2'-cyanine iodide, 3,3'-diethyl-6,6'-dinitro-9-phenylthiacarbocyanine iodide, 3,3'-di-p-nitrophenylthiacarboyanine iodide, 3,3'-dimethyl-9-trifluoromethylthiocarbocyanine iodide, 9-(2,4-dinitrophenylmercapto)-3,3'-diethylthiocarbocyanine iodide, etc.

The pyrimidone and thiopyrimidone dyes are also suitable spectrally sensitizing electron-acceptors.

Especially useful non-spectrally sensitizing electron-acceptors for the direct-positive silver halide emulsion layers of the photographic element according to the present invention are nitrostyryl and nitrobenzylidene dyes representatives of which can be found in U.S. Pat. No. 2,953,561 of Norman J. Doorenbos, issued Sept. 20, 1960.

They can be represented as described in U.S. Pat. No. 3,615,610 mentioned above, by the following general formulae:

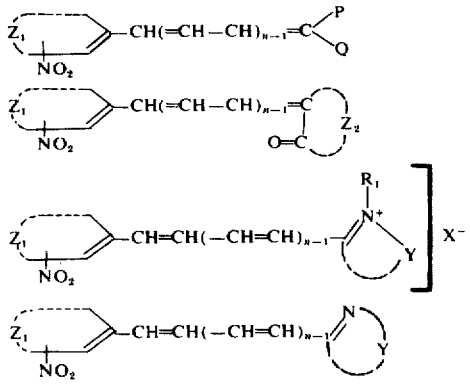

wherein one or more of the methine groups may be substituted e.g. with a cyano group, $R_1$, $X^-$ and Y have the same significance as described above, $Z_1$ represents the necessary atoms to close an aromatic nucleus e.g. a benzene nucleus, which may be further substituted e.g. with another nitro group, each of P and Q represents an organic group with electronegative character e.g.

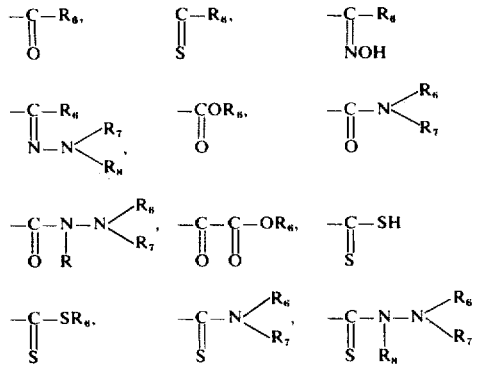

(wherein each of $R_6$, $R_7$, and $R_8$ represents a hydrogen atom, an alkyl group, an aryl group, an aralkyl group, or a heterocyclic group, which groups may be substituted), $—NO_2$, —CN, an aromatic homocyclic monovalent group e.g. phenyl or naphthyl, which group may be substituted preferably with an electronegative group as hereinbefore described or a monovalent heterocyclic group with aromatic character e.g. a furyl, thienyl, pyrrolyl, indolyl, or

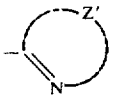

group, wherein Z' represents the necessary atoms to close a heterocyclic nucleus with aromatic character, which groups may be substituted, $Z_2$ represents the necessary atoms to close a cyclic ketomethylene nucleus such as one of those of the pyrazolone series e.g., 3-methyl-1-phenyl-5-pyrazolone, 1-phenyl-5-pyrazolone, 1-(2-benzothiazolyl)-3-methyl-5-pyrazolone, those of the isoxazolone series e.g., 3-phenyl-5-isoxazolone, or 3-methyl-5-isoxazolone, those of the oxindole series e.g. 1-alkyl-2,3-dihydro-2-oxindoles, those of the 2,4,6-triketohexahydropyrimidine series e.g. barbituric acid or 2-thiobarbituric acid as well as their derivatives such as those substituted in the 1-position by an alkyl group such as a methyl group, an ethyl group, an 1-n-propyl group, and a 1-n-heptyl group, or those substituted in the 1- and 3-position by an alkyl group, or those substituted in the 1- or 3-position by a β-methoxy-ethyl group, or those substituted in the 1- and 3-position by an aryl group such as phenyl group, or those substituted in the 1- and 3-position by a substituted phenyl group such as a p-chlorophenyl group, or a p-ethoxycarbonylphenyl group, or those substituted only in the 1-position by a phenyl-, p-chlorophenyl-, or p-ethoxycarbonylphenyl group, further the mixed alkyl-aryl-substituted derivatives such as 1-ethyl-3-phenyl, and 1-n-heptyl-3-phenyl derivatives, those of the rhodanine series i.e., 2-thio-2,4-thiazolidinedione series, e.g. rhodanine, and aliphatically substituted rhodanines e.g., 3-ethyl-rhodanine, or 3-allylrhodanine, those of the imidazo[1,2-a]pyridone series, those of the 5,7-dioxo-6,7-dihydro-5-thiazole [3,2-a]pyrimidine series e.g. 5,7-dioxo-3-phenyl-6,7-dihydro-5-thiazolo[3,2-a]pyrimidine, those of the 2-thio-2,4-oxazolidinedione series i.e. those of the 2-thio-2,4-oxazoledione series e.g. 3-ethyl-2-thio-2,4-oxoazolidinedione, those of the thianaphthenone series e.g. 3-thianaphthenone, those of the 2-thio-2,5-thiazolidinedione series i.e. the 2-thio-2,5-thiazoledione series e.g. 3-ethyl-2-thio-2,5-thiazolidinedione, those of the 2,4-thiazolidinedione series e.g. 2,4-thiazolidinedione, 3-ethyl-2,4-thiazolidinedione, 3-phenyl-2,4-thiazolidinedione, 3-α-naphthyl-2,4-thiazolidinedione, those of the thiazolidone series e.g. 4-thiazolidone, 3-ethyl-4-thiazolidone, 3-phenyl-4-thiazolidone, 3-α-naphthyl-4-thiazolidone, those of the 4-thiazolone series e.g. 2-ethylmercapto-4-thiazolone, 2-alkylphenylamino-4-thiazolones, 2-diphenylamino-4-thiazolone, those of the 2-imino-2,4-oxazolinone i.e. pseudohydantoin series, those of the 2,4-imidazolinedione (hydantoin) series e.g. 2,4-imidazolinedione, 3-ethyl-2,4-imidazolinedione, 3-phenyl-2,4-imidazolinedione, 3-α-naphthyl-2,4-imidazolinedione, 1,3-diethyl-2,4-imidazolinedione, 1-ethyl-3-phenyl-2,4-imidazolinedione, 1-ethyl-3-α-naphthyl-2,4-imidazolinedione, 1,3-diphenyl-2,4 -imidazolinedione, those of the 2-thio-2,4-imidazolinedione (i.e. 2-thiohydantoin) series, e.g., 2-thio-2,4-imidazolinedione, 3-ethyl-2-thio-2,4-imidazolinedione, 3-phenyl-2-thio-2,4-imidazolinedione, 3-α-naphthyl-2-thio-2,4Z-imidazolinedione, 1,3-diethyl-2-thio-2,4-imidazolinedione, 1-ethyl-3-phenyl-2-thio-2,4-imidazolinedione, 1-ethyl-3-α-naphthyl-2-thio-2,4-imidazolinedione, 1,3-diphenyl-2-thio-2,4-imidazolinedione, those of the 5-imidazolone series e.g. 2-n-propylmercapto-5-imidazolone, and those of the homocyclic ring systems represented by the following structural formulae:

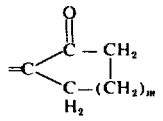

wherein m represents 1, 2, or 3,

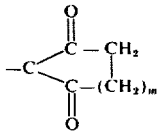

wherein m represents 1, 2, or 3,

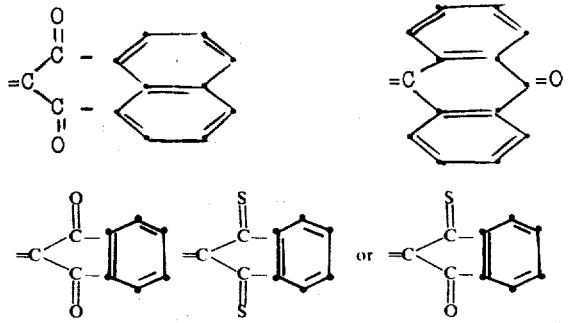

*n* represents a positive integer 1 or 2.

Particularly suitable desensitizing methine dyes according to said general formulae are listed in the following table 2.

Table 2

I.

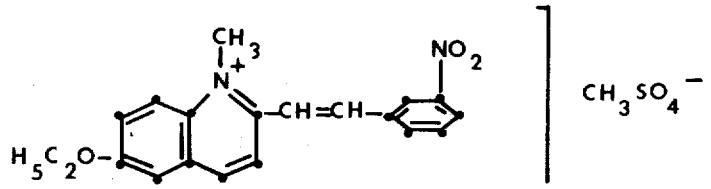

II.

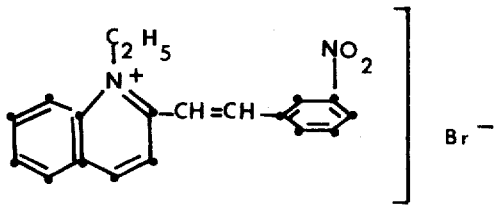

III.

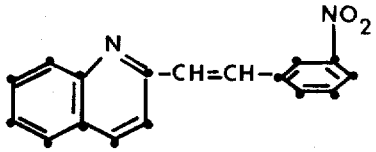

-continued

IV. 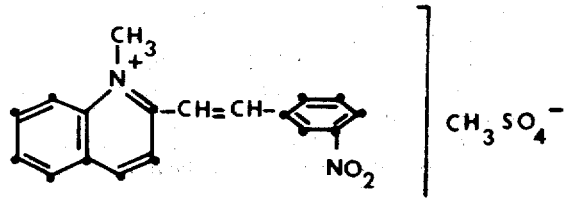

V. 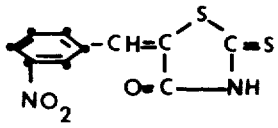

Other examples of non-spectrally sensitizing electron-acceptors include 2,3,5-triphenyl-2H-tetrazolium chloride, 2-(4-iodo-phenyl)-3-(4-nitrophenyl)-5-phenyl tetrazolium chloride, 1-methyl-8-nitroquinolinium methyl sulphate, 1-m-nitrobenzyl-quinolinium chloride, 1-m-nitrobenzylpyridinium chloride, 1-p-nitrobenzylisoquinolinium chloride, 1-p-nitrobenzylbenzo[f-]quinolinium chloride, 1-methyl-2-m-nitrostyryl-quinolinium methyl sulphate, and dihydropyrimidine compounds.

The spectrally sensitizing as well as the non-spectrally sensitizing electron-acceptors are preferably incorporated in the washed, finished silver halide emulsions and should be uniformly distributed throughout the emulsions. They can be incorporated according to methods well known to those skilled in the art of emulsion making e.g. from solutions in appropriate solvents such as water, methanol, ethanol, pyridine, etc. or mixtures of solvents.

The electron acceptors can be used in both emulsion layers in widely varying concentrations. The total amount of electron acceptor(s) added to each emulsion is preferably comprised between about 50 mg and about 2000 mg, preferably between about 100 mg and 1000 mg per mole of silver halide. In the uppermost direct-positive silver halide emulsion layer, it is possible to use in addition to the spectrally-sensitizing electron-acceptor a non-spectrally sensitizing electron-acceptor; the ratio of the non-spectrally sensitizing to the spectrally sensitizing electron-acceptor is then preferably comprised between about 1:3 and about 3:1.

The silver halides employed in the direct-positive silver halide emulsions described herein include silver bromide, silver chloride, silver chloroiodide, silver bromoiodide and silver chlorobromoiodide. Emulsion blends can also be used e.g. blends of silver chloride and silver chlorobromide.

The silver halide grains of the direct-positive silver halide emulsions used in the photographic element of the present invention are fogged according to methods well known in the art. They may be fogged e.g. by an overall exposure to actinic radiation or by reduction sensitization e.g. by high pH and/or low pAg silver halide precipitating or digestion conditions e.g. as described by Wood, J.Photo.Sci. 1 (1953) 163, or by treatment with reducing agents. Fogging may also occur by reduction sensitization in the presence of a compound of a metal more electropositive than silver.

Reducing agents suitable for use include hydrazine, hydroxylamine, tin(II) compounds e.g. tin(II) chloride, tin complexes and tin chelates of the (poly)amino(-poly)carboxylic acid type, ascorbic acid, formaldehyde, thiourea dioxide, polyamines such as diethylene triamine, phosphonium salts such as tetra (hydroxymethyl)phosphonium chloride, bis(p-aminoethyl)sulphide and its water-soluble salts, etc. Preferred reducing agents are thiourea dioxide and tin(II) chloride.

The compounds of a metal more electropositive than silver include gold compounds e.g. gold(III)chloride, potassium chloroaurate, potassium chloroaurite, and potassium aurithiocyanate, as well as compounds of rhodium, platinum, iridium and palladium e.g. ammonium hexachloropalladate and potassium chloroiridate. Preferred noble metal compounds are gold compounds.

When fogging of the silver halide grains occurs by means of a reducing agent e.g. thiourea dioxide and a compound of a metal more electropositive than silver especially a gold compound, the reducing agent is preferably used initially and the gold compound subsequently. However, the reverse order can be used or both compounds can be used simultaneously.

The degree of fogging of the direct-positive emulsions used according to the invention may vary within a wide range. This degree of fogging depends, as is known in the art, on the concentration of the fogging agents used as well as on the pH, the pAg, the temperature and the duration of the fogging treatment. High photographic sensitivities are obtained at low degrees of fogging (see e.g. U.S. Pat. No. 3,501,307 mentioned above). Thus, the degree of fogging can be adapted according to the requirements of desired sensitivity.

In accordance with the present invention, the emulsion characteristics such as grain-size and fog level of both direct-positive silver halide emulsion layers can be selected so that both emulsion layers have the same or different inherent sensitivity.

According to a preferred embodiment of the present invention, the undermost silver halide emulsion layer has lower inherent sensitivity than the uppermost emulsion layer which favours the reduction of the contrast with retention of high maximum density.

According to another preferred embodiment of the present invention at least one of the direct-positive silver halide emulsion layers comprises a mixture of at least two emulsions of different inherent sensitivity which may be due to different grain-size and/or fog level.

In the formation of the direct-positive silver halide emulsions used according to the present invention various colloids can be used as vehicles or binding agents for the silver halide. They include any of the hydrophilic colloids generally employed in the photographic field for example gelatin, colloidal albumin, casein, cellulose derivatives e.g. carboxymethyl cellulose, alginic acid and derivatives thereof such as esters, amides and salts thereof, synthetic resins e.g. polyvinyl compounds such as polyvinyl alcohol and poly-N-vinylpyrrolidone. However, gelatin is preferably used.

In addition to the hydrophilic binding agents other synthetic binding agents can be employed in the emulsion e.g. homo- and copolymers of acrylic or methacrylic acid or derivatives thereof such as esters, amides and nitriles and vinyl polymers for example polyvinyl esters and polyvinyl ethers.

The direct-positive photographic silver halide emulsions can be coated on a wide variety of supports which include opaque supports e.g. paper and metal supports as well as transparent supports e.g. glass, cellulose nitrate film, cellulose acetate film, cellulose aceto-butyrate film, polyvinyl acetal film, polystyrene film, polyethylene terephthalate film and other polyester film. It is also possible to employ paper coated with $\alpha$-olefin polymers e.g. paper coated with polyethylene, polypropylene, ethylene-butylene copolymers and the like.

The silver halide emulsion layer and any other hydrophilic colloid layer which may be present in a direct-positive photographic material of the invention may be hardened with any suitable hardener used in silver halide materials e.g. formaldehyde, dialdehyde, hydroxyaldehyde, mucochloric and mucobromic acid, acrolein, glyoxal, sulphonyl halides, vinyl sulphones, etc. These layers may further comprise colour couplers, plasticizers, surface active agents of the non-ionic, ionic or amphoteric type, antistatic agents, matting agents, e.g. starch, silica, polymethyl methacrylate, zinc oxide, titanium dioxide, etc., optical brightening agents, including stilbene, triazine, oxazole, and coumarin brightening agents, and the like. Light-absorbing dyes may be homogeneously distributed throughout both emulsion layers or throughout the undermost emulsion layer alone. It is also possible to provide an intermediate filter layer which comprises a light-absorbing dye or a relatively insensitive silver halide emulsion layer between both emulsion layers.

The silver halide emulsion may further contain any of the ingredients generally employed in silver halide emulsions. They may comprise speed increasing agents of the polyalkylene oxide type e.g. polyethylene glycols and derivatives thereof, quaternary ammonium and phosphonium compounds as well as ternary sulphonium compounds, thioether compounds etc. The emulsions can comprise the common emulsion stabilizing agents e.g. mercury compounds which include homopolar or salt-like compounds of mercury and aromatic or heterocyclic compounds such as mercaptotriazoles, simple mercury salts, sulphonium mercury double salts, etc. They may comprise azaindene emulsion stabilizers for example tetra- or pentaazaindenes especially those comprising hydroxyl or amino groups as described by Birr, Z.Wiss.Phot. 47 (1962) 2–58. Other suitable emulsion stabilizers are heterocyclic mercapto compounds e.g. 1-phenyl-5-mercaptotetrazole, quaternary benzthiazolium derivatives, benztriazole and the like.

Photographic elements comprising two direct-positive silver halide emulsion layers as described herein show extended exposure latitude and are particularly suitable for the production of continuous-tone images e.g. for duplicating radiographs.

The following examples illustrate the present invention.

EXAMPLE 1

Two direct-positive, fogged silver bromoiodide (2 mole % of iodide) emulsions A and B were prepared. They comprised both per kg 95 g of silver halide and the ratio of gelatin to silver halide expressed as silver nitrate was 0.45.

The inherent sensitivity of emulsion A having an average grain diameter of about 0.45 micron was about 40 percent higher than the inherent sensitivity of emulsion B having an average grain diameter of about 0.25 micron.

3 parts by weight of emulsion A were admixed with 1 part by weight of emulsion B and the mixture was then divided into two aliquot samples I and II.

To emulsion sample I, 425 mg of the following nitrostyryl compound were added per mole of silver halide:

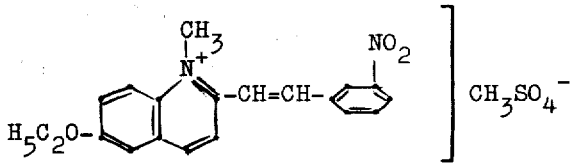

To emulsion sample II, 190 mg of the above nitrostyryl compound and 235 mg of the following methine dye were added per mole of silver halide:

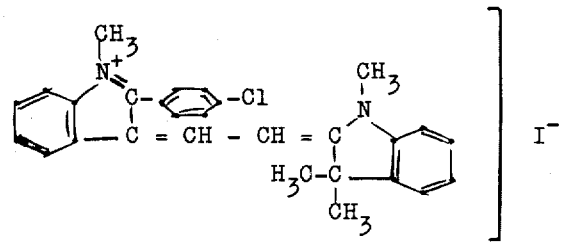

To both emulsion samples, coating aids and hardening agents were added in the usual way.

In order to form a light-sensitive direct-positive element according to the present invention, part of emulsion sample I was coated on a polyethylene terephthalate support and overcoated with a same part of emulsion sample II which in its turn was overcoated with a gelatin antistress layer. In this way the undermost emulsion layer contained nitrostyryl compound alone whereas the uppermost emulsion layer contained both nitrostyryl compound and methine dye.

For comparison purposes two elements were prepared in which either both emulsion layers contained the nitrostyryl compound alone (comparison element 1) or both emulsion layers contained both the nitrostyryl compound and the methine dye (comparison element 2). These elements were prepared in exactly the same way as the element of the invention except that either emulsion sample I was coated two times (same parts as for the element of the invention) or emulsion sample II was coated two times (same parts as for the element of the invention).

The elements were exposed through a continuous grey wedge with constant 0.15 by means of ordinary incandescent bulbs.

The exposed elements were processed in an automatic 90 seconds processing machine. Development occcurred for 23 seconds of 35°C in Agfa-Gevaert's hardening developer for automatic processing G 138, which comprises hydroquinone and 1-phenyl-3-pyrazolidinone as developing agents and glutaraldehyde as hardener.

The sensitometric results are listed in the following table.

The values given for the speed are relative values with respect to the speed of the element of the invention, the speed of which has been given a value of 100.

The speed is denoted in the table by the letter S. The density in the exposed areas is a measure of the brightness of the whites and is denoted in the table by $D_{min}$. The maximum density and gamma are denoted by $D_{max}$ and g.

Table

| Element | $D_{min}$ | g | S | $D_{max}$ |
|---|---|---|---|---|
| element of invention | 0.03 | 1.44 | 100 | 2.80 |
| comparison element 1 | 0.02 | 1.61 | 65 | 2.90 |
| comparison element 2 | 0.03 | 1.60 | 135 | 2.80 |

The above results show that for approximately the same $D_{max}$, the element of the invention shows reduced gradation. The comparison elements have approximately the same gradation.

EXAMPLE 2

A direct-positive silver halide element according to the present invention was prepared by coating on a polyethylene terephthalate support in the order of sequence:

a. an emulsion B, prepared as described in example 1 to which 425 mg of the nitrostyryl compound of example 1 were added per mole of silver halide as well as coating aids and hardening agents as usual;

b. an emulsion A, prepared as described in example 1 to which 190 mg of the nitrostyryl compound of example 1 and 235 mg of the methine dye of example 1 were added per mole of silver halide as well as coating aids and hardening agents as usual, and c. a gelatin antistress layer.

For comparison purposes an element was prepared by coating under identical circumstances on a polyethylene terephthalate support in the order of sequence:

a. an emulsion B, prepared as described in example 1, to which 190 mg of the nitrostyryl compound of example 1 and 235 mg of the methine dye of example 1 were added per mole of silver halide as well as coating aids and hardening agents as usual, b. an emulsion A, prepared as described in example 1, to which 190 mg of the nitrostyryl compound of example 1 and 235 mg of the methine dye of example 1 were added per mole of silver halide as well as coating aids and hardening agents as usual, and c. a gelatin antistress layer.

Both elements were exposed and processed as described in example 1.

The sensitometric results attained are listed in the following table.

| Element | $D_{min}$ | g | S | $D_{max}$ |
|---|---|---|---|---|
| of invention | 0.03 | 1.32 | 100 | 2.75 |
| for comparison | 0.03 | 1.43 | 180 | 2.65 |

The above results show that for approximately the same $D_{max}$, the element of the invention has reduced gradation.

EXAMPLE 3

An emulsion was prepared by admixture of 3 parts by weight of emulsion A described in example 1 with 1 part by weight of emulsion B described in example 1.

The emulsion was divided into several aliquot portions and to each portion the electon-acceptor(s) of example 1 as listed in the table were added in the amount given per mole of silver halide.

Light-sensitive direct-positive elements were prepared by coating on a polyethylene terephthalate support one of the emulsion portions which was then overcoated with another of the emulsion portions formed.

The elements were exposed through a continuous grey wedge with constant 0.15 by means of ordinary incandescent bulbs.

The exposed elements were processed in an automatic 90 seconds processing machine. Development occurred for 23 seconds at 35°C in Agfa-Gevaerts hardening developer for automatic processing G 138 which comprises hydroquinone and 1-phenyl-3-pyrazolidinone as developing agents and glutaraldehyde as hardener.

The sensitometric results are listed in the following table.

| Element | Electron-acceptors in undermost layer | Electron-acceptors in uppermost layer | $D_{min}$ | g | S | $D_{max}$ |
|---|---|---|---|---|---|---|
| A | 425 mg nitrostyryl compound (a) | 425 mg nitrostyryl compound (a) | 0.04 | 1.50 | 66 | 2.90 |
| B | 425 mg methine dye (b) | 425 mg methine dye (b) | 0.06 | 1.59 | 100 | 3.04 |
| C | 190 mg (a) + 235 mg (b) | 190 mg (a) + 235 mg (b) | 0.04 | 1.55 | 162 | 3.00 |
| D | 425 mg (a) | 190 mg (a) + 235 mg (b) | 0.03 | 1.40 | 100 | 3.00 |
| E | 425 mg (a) | 425 mg (b) | 0.05 | 1.44 | 126 | 3.00 |

The above results show that for approximately the same $D_{max}$, the elements D and E according to the present invention have reduced gradation as compared with the comparative elements A, B and C.

We claim:

1. A photographic multilayer direct-positive silver halide element comprising a support, at least two direct-positive silver halide emulsion layers each containing fogged silver halide grains, wherein the undermost and uppermost emulsion layers of the said direct-positive silver halide emulsion layers comprise at least one non-spectrally sensitizing electron-acceptor, and said uppermost emulsion layer of the said direct-positive silver halide emulsion layers comprise at least one spectrally sensitizing electron-acceptor.

2. A photographic element according to claim 1, wherein the spectrally and non spectrally sensitizing electron-acceptors each have an anodic polarographic halfwave potential and a cathodic polarographic halfwave potential which, when added together, give a positive sum.

3. A photographic element according to claim 1, wherein the uppermost emulsion layer comprises both a non-spectrally sensitizing electron-acceptor and a spectrally sensitizing electron-acceptor in a ratio relative to each other comprised between about 1:3 and about 3:1.

4. A photographic element according to claim 1, wherein the spectrally sensitizing electron-acceptor is a methine dye with at least one indolo nucleus having a carbocyclic aromatic ring in the 2-position.

5. A photographic element according to claim 4, wherein the spectrally sensitizing electron-acceptor is a 2-phenyl-indole methine dye corresponding to the formula:

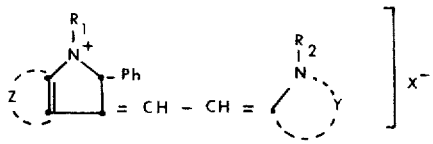

wherein:

each of $R_1$ and $R_2$ represents an alkyl group, or an aryl group,

Ph is a phenyl group,

Z represents the atoms necessary to close a fused-on benzene nucleus,

Y represents the atoms necessary to complete a heterocyclic nucleus as known in cyanine dye chemistry, and X represents an anion but is not present when $R_1$ itself contains an anionic group.

6. A photographic element according to claim 1, wherein the non-spectrally sensitizing electron-acceptor is a nitrostyryl or nitrobenzylidene dye.

7. A photographic element according to claim 6, wherein said nitrostyryl or nitrobenzylidene dye corresponds to one of the formulae:

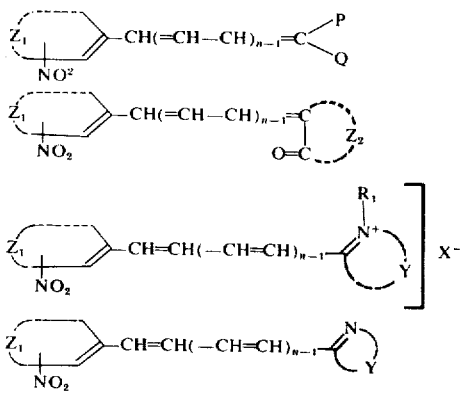

wherein:

$R_1$ is an alkyl group,

Y represents the necessary atoms to complete a heterocyclic nucleus of the type used in the production of cyanine dyes, $Z_1$ represents the necessary atoms to close a benzene nucleus, each of P and Q is an organic group with electronegative character, $Z_2$ represents the atoms necessary to close a cyclic ketomethylene nucleus, $Z^-$ is an anion but does not exist when $R_1$ contains an anionic group, and

*n* is 1 or 2.

8. A photographic element according to claim 1 wherein the undermost silver halide emulsion layer comprises as nonspectrally sensitizing electron-acceptor a nitrostyryl or nitrobenzylidene dye and the uppermost silver halide emulsion layer comprises as spectrally sensitizing electron-acceptor a 2-phenyl-indole methine dye.

9. A photographic element according to claim 8, wherein the uppermost emulsion layer also comprises the same non-spectrally sensitizing electron acceptor as present in the undermost emulsion layer.

10. A photographic element according to claim 1, wherein the electron-acceptors are present in each of the emulsion layers in a total amount (for a particular emulsion layer) between about 50 mg and about 2000 mg per mole of silver halide.

11. A photographic element according to claim 1, wherein the undermost silver halide emulsion layer has lower inherent sensitivity than the uppermost silver halide emulsion layer.

12. A photographic element according to claim 1, wherein one or both emulsion layers consist of a mixture of at least two emulsions of different inherent sensitivity

13. A photographic element according to claim 8 wherein the nitrostyryl or nitrobenzylidene dye corresponds to one of the formulae:

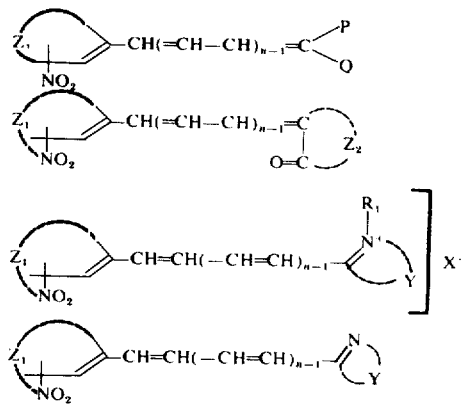

wherein:

$R_1$ is an alkyl group,

Y represents the necessary atoms to complete a heterocyclic nucleus of the type used in the production of cyanine dyes, $Z_1$ represents the necessary atoms to close a benzene nucleus, each of P and Q is an organic group with electronegative character, $Z_2$ represents the atoms necessary to close a cyclic ketomethylene nucleus, $X^-$ is an anion but does not exist when $R_1$ contains an anionic group, and

*n* is 1 or 2.

14. A photographic element according to claim 13 wherein the 2-phenyl-indole methine dye corresponds to the formula:

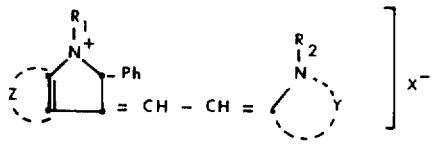

wherein:

each of $R_1$ and $R_2$ represents an alkyl group, or an aryl group,

Ph is a phenyl group,

Z represents the atoms necessary to close a fused-on benzene nucleus,

Y represents the atoms necessary to complete a heterocyclic nucleus as known in cyanine dye chemistry, and X represents an anion but is not present when $R_1$ itself contains an anionic group.

* * * * *